US005277342A

United States Patent [19]

Dickau et al.

[11] Patent Number: 5,277,342

[45] Date of Patent: Jan. 11, 1994

[54] SEALLESS DISPENSING APPARATUS

[75] Inventors: Ewald F. Dickau, Glastonbury; Mark Holmes, Quaker Hill, both of Conn.

[73] Assignee: Loctite Corporation, Hartford, Conn.

[21] Appl. No.: 989,162

[22] Filed: Dec. 11, 1992

[51] Int. Cl.[5] ..... B67D 5/42

[52] U.S. Cl. ..... 222/387; 222/510; 251/320; 277/200

[58] Field of Search ..... 222/504, 510, 518, 386, 222/387, 476; 277/200; 251/320

[56] References Cited

U.S. PATENT DOCUMENTS 2,111,168 3/1938 Chansor .
3,162,335 12/1964 Kogan et al. .
3,241,727 3/1966 Heckman .
3,463,363 8/1969 Zelna .
3,731,851 5/1973 Rauh .
3,734,350 5/1973 Waterman et al. .
3,794,222 2/1974 Loewenthal .
3,871,558 3/1975 Gournelle .
3,954,206 5/1976 Salonen .
3,976,229 8/1976 Jackson .
3,995,780 12/1976 Showalter .
4,006,845 2/1977 Scholl et al. .
4,066,188 1/1978 Scholl et al. .
4,090,643 5/1978 Wilkinson, Jr. et al. .
4,099,653 7/1978 Scholl et al. .
4,126,321 11/1978 Harjar et al. .
4,144,913 3/1979 Akers et al. .
4,153,186 5/1979 Nye .
4,226,342 10/1980 Laauwe .
4,240,610 12/1980 Trimble .
4,303,108 12/1981 Akers et al. .
4,643,581 2/1987 Soechtig et al. .
4,678,100 7/1987 Gelinas et al. .
4,858,789 8/1989 Breault et al. .
4,930,669 6/1990 Dickau et al. .
4,955,514 9/1990 Dickau .
5,014,883 5/1991 Airaksinen ..... 222/510 X
5,029,401 7/1991 Masom .
5,037,065 8/1991 Hirz et al. .
5,058,861 10/1991 Baumann .

*Primary Examiner*—Gregory L. Huson
*Attorney, Agent, or Firm*—Hoffmann & Baron

[57] ABSTRACT

A dispensing apparatus capable of dispensing a wide variety of fluids, such as adhesives, is provided. The structure of the apparatus allows it to be miniaturized, thereby facilitating its use for many applications. The apparatus includes a cylindrical housing in which a slide is mounted. The housing includes a fluid reservoir which is supplied with pressurized fluid. A longitudinal passage extends through the slide for providing this fluid to the reservoir. A bellow seal is employed for sealing off an actuating mechanism from the reservoir. The seal is connected between the slide and a support fixedly mounted to the housing. A valve mechanism is provided at one end of the housing for controlling the flow of fluid from the reservoir. The valve mechanism is directly or indirectly responsive to the slide. Fluid may be caused to flow through the valve mechanism either by fluid pressure or by positive displacement.

20 Claims, 4 Drawing Sheets

SEALLESS DISPENSING APPARATUS

BACKGROUND OF THE INVENTION

1. Field of the Invention

The field of the invention relates to fluid dispensing mechanisms and, more particularly, to an improved dispensing apparatus which may be miniaturized and which is capable of delivering precisely controlled quantities of fluid.

2. Brief Description of the Prior Art

There are a number of known designs for dispensing fluids such as adhesives, sealants, and the like at accurately controlled flow rates, in accurate quantities, and for accurate placement on a receiving surface.

In certain designs, fluid is introduced under pressure to a reservoir and dispensed upon movement of a valve member off a valve seat. U.S. Pat. Nos. 4,930,669 and 4,955,514 disclose two such designs. Each design is sealless, which is highly advantageous for dispensing fluids which tend to leak through and/or destroy conventional seals.

Another type of dispensing apparatus is disclosed in U.S. Pat. No. 4,858,789. This design allows the positive displacement of precise quantities of fluid from a reservoir. All three patented devices discussed above employ a deformable diaphragm for isolating the reservoir from the mechanism which actuates the valve, thereby preventing the undesirable entry of product into the mechanism.

Other types of dispensers are disclosed in U.S. Pat. Nos. 4,066,188, 4,066,845, 4,099,653 and 4,126,321. The first three patented dispensers are designed primarily for dispensing hot, viscous fluids, while the latter is designed for use as a spray gun. Each employs a bellows seal for isolating a fluid reservoir from an actuating mechanism.

U.S. Pat. No. 3,871,558 discloses an apparatus for dispensing viscous products such as liquid soap via positive displacement. The products are confined by a bellows-type membrane.

There are many different types of fluids which require the use of a dispensing apparatus. Such fluids have a very broad range of viscosities, curing properties, and other characteristics which may preclude the use of certain types of dispensers. Cyanoacrylates, for example, of relatively low viscosities tend to diffuse with polymers and then cure. These properties make the use of dynamic seals in a dispenser very disadvantageous. If high pressure within the fluid reservoir is required, diaphragm seals become disadvantageous as the pressure against such seals must be overcome in order to move the stem or slide to which the valve member is secured.

Fluid dispensers may also be used in a wide variety of applications, some of which require incorporation of the dispenser within sophisticated machinery. Others may require the ability to manipulate the dispenser manually. The ability to manufacture a dispenser which is small in size and easily manipulated by hand is important in many applications. As the fluid reservoirs of many dispensers are supplied with fluid through fittings in the reservoir walls, the dispensers are rather difficult to handle as the fittings and associated tubing are obstructions which must be avoided.

The ability to miniaturize existing dispenser designs is often limited due to the manner in which fluid is supplied to the reservoir, as described above. Other internal structures in many dispensers also severely limit the extent to which they can be miniaturized. As small size and light weight are advantageous features in a number of applications, many prior art dispensers are of only limited utility.

SUMMARY OF THE INVENTION

The present invention is directed to a dispensing apparatus which is usable for dispensing a wide variety of fluids. The structure of the apparatus is such that it lends itself to miniaturization. It is also capable of withstanding high pressure and dispensing precise quantities of fluid. The fluid may be displaced from a reservoir within the apparatus either due to pressure within the reservoir or via positive displacement.

The dispensing apparatus according to the invention includes a housing which defines a reservoir for containing the fluid material to be dispensed. It further includes a discharge port through which the material in the reservoir may exit. An elongate slide is positioned within the housing. The slide includes a longitudinal passage extending at least partially therethrough and a port which provides fluid communication between the passage and reservoir. The reservoir may accordingly be filled by supplying fluid through the passage in the slide. A longitudinally expandable seal, such as a bellows seal, is positioned within the reservoir. The seal is secured to the slide. A support is provided within the housing, the slide extending through and preferably supported by the support. The seal is also secured to the supporting means, thereby preventing fluid from entering the supporting means. Valve means, responsive to the slide, are provided for controlling the dispensing of fluid through the discharge port.

DETAILED DESCRIPTION OF THE PREFERRED EMBODIMENTS

Referring to the Figures, FIGS. 1-3 and 5 illustrate a first embodiment of the invention wherein fluid is dispensed due to internal pressure provided within a fluid reservoir. The apparatus 10 shown in these Figures includes a substantially cylindrical housing 12, a substantially cylindrical slide 14 extending through and substantially coaxial with the longitudinal axis of the housing, and a funnel-shaped nozzle 16 secured to one end of the housing. All of these elements may be made from polypropylene or other corrosion-resistant material. The slide may alternatively be made from an acetal resin as sold under the trademark DELRIN, or stainless steel.

Figure 1:
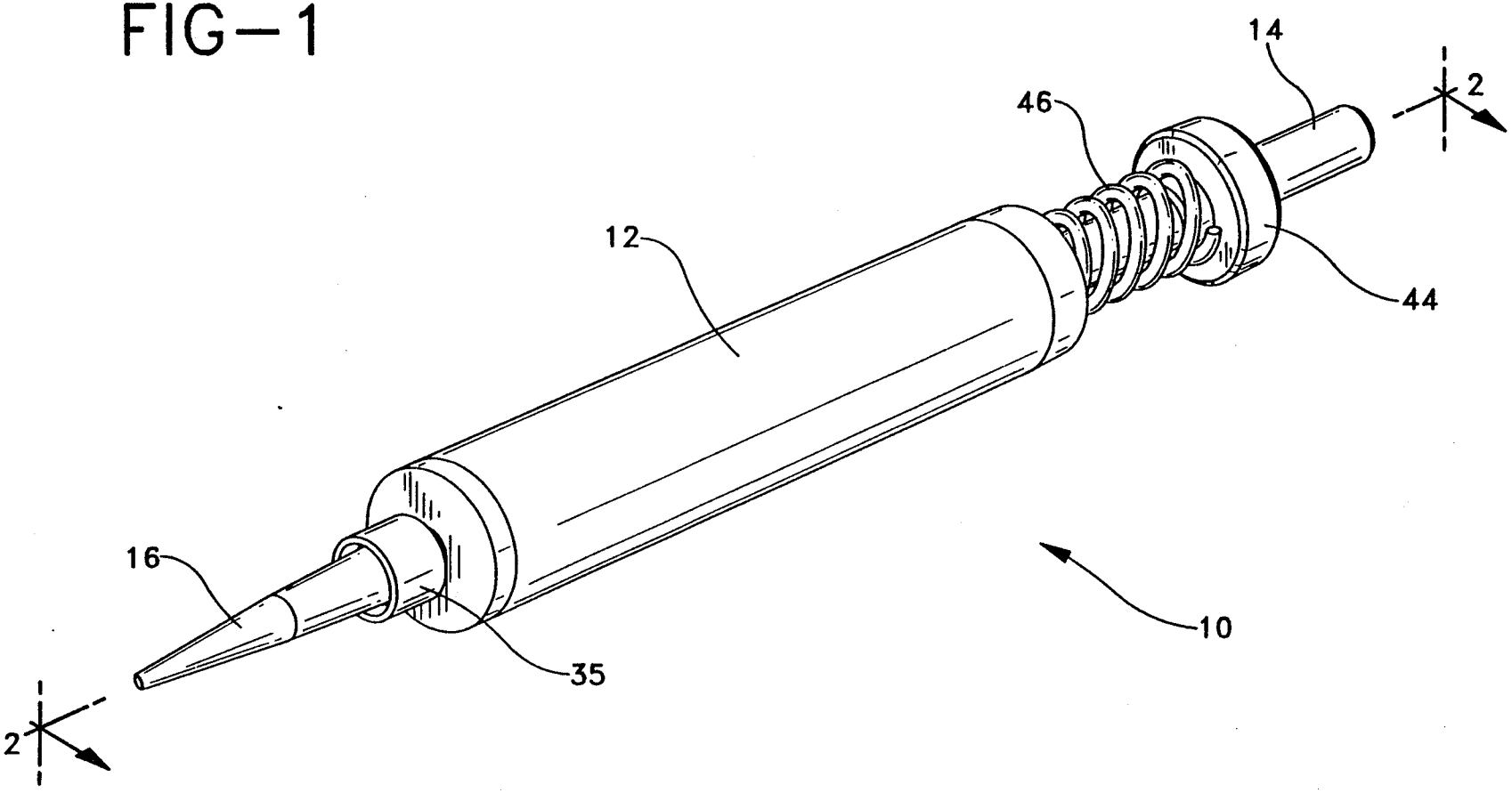
FIG. 1 is a top perspective view of a dispensing apparatus according to the invention.
Figure 2:
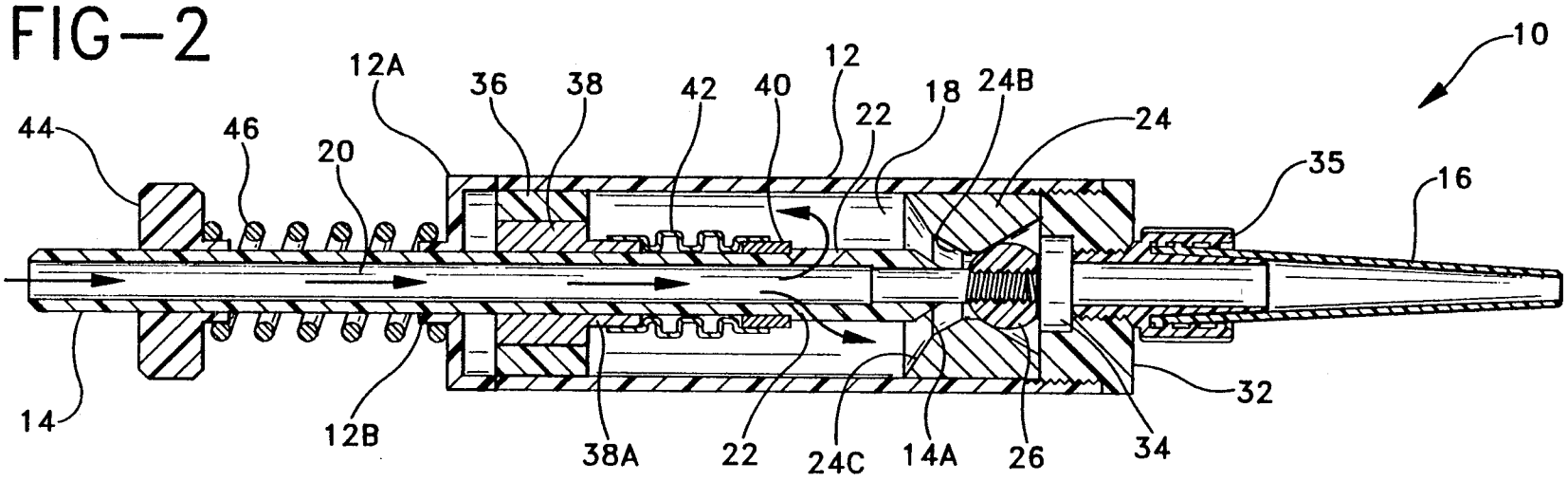
FIG. 2 is a sectional view thereof taken along line 2—2 in FIG. 1.
Figure 3:
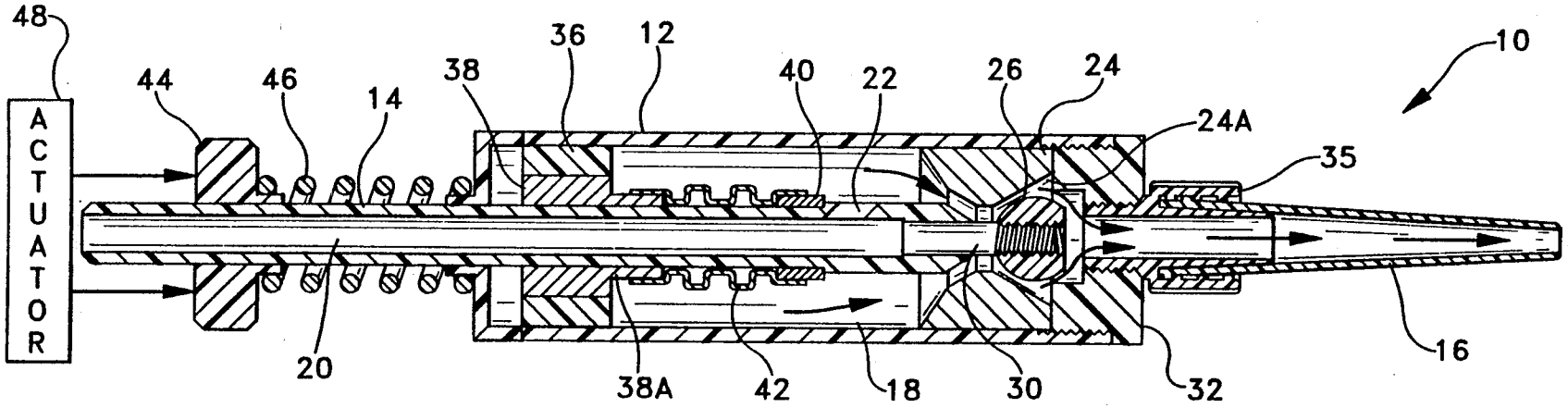
FIG. 3 is a sectional view thereof showing the apparatus in the dispensing mode.

Referring to FIGS. 2–3, a reservoir 18 is defined in part by the walls of the housing 12. Fluid is preferably supplied to the reservoir through a passage 20 extending along the longitudinal axis of the slide 14. Fluid exits the passage via one or more ports 22 extending through the wall of the slide. The ports 22 are preferably oriented towards the discharge end of the apparatus.

The passage 20 within the slide extends from the rear end of the slide to the ports 22 or a point slightly beyond the ports. The front end of the slide is accordingly closed.

The front, or discharge end of the apparatus is preferably designed to allow a selection of valving mechanisms. A valve seat 24 is positioned within the housing and is secured to the inner surface of the housing 12. The valve seat includes a passage having one end defined by a frustoconical surface 24A and a second end defined by adjoining frustoconical surfaces 24B, 24C. The slide 14 includes a frustoconical end portion 14A corresponding in dimension to one of the surfaces 24B of the rear end of the valve seat. The slide and valve seat may accordingly function as a needle valve assembly, not unlike that disclosed in U.S. Pat. No. 3,463,363. Such an assembly may be preferable in some applications where the apparatus is controlled by a programmable controller.

In accordance with the generally preferred embodiment of the invention, valving is accomplished by means of a valve member 26 which is sealingly engageable with the frustoconical surface 24A at the front end of the valve seal 24. The valve member may be substantially spherical, as shown, or of other configurations which allow such sealing engagement. The valve member is preferably made from polypropylene, while the valve seat is stainless steel. Like all of the components of the apparatus which are exposed to the fluid material to be dispensed, the valve member and valve seat must be resistant to the highly corrosive materials which are commonly dispensed by this type of apparatus.

Figure 4:
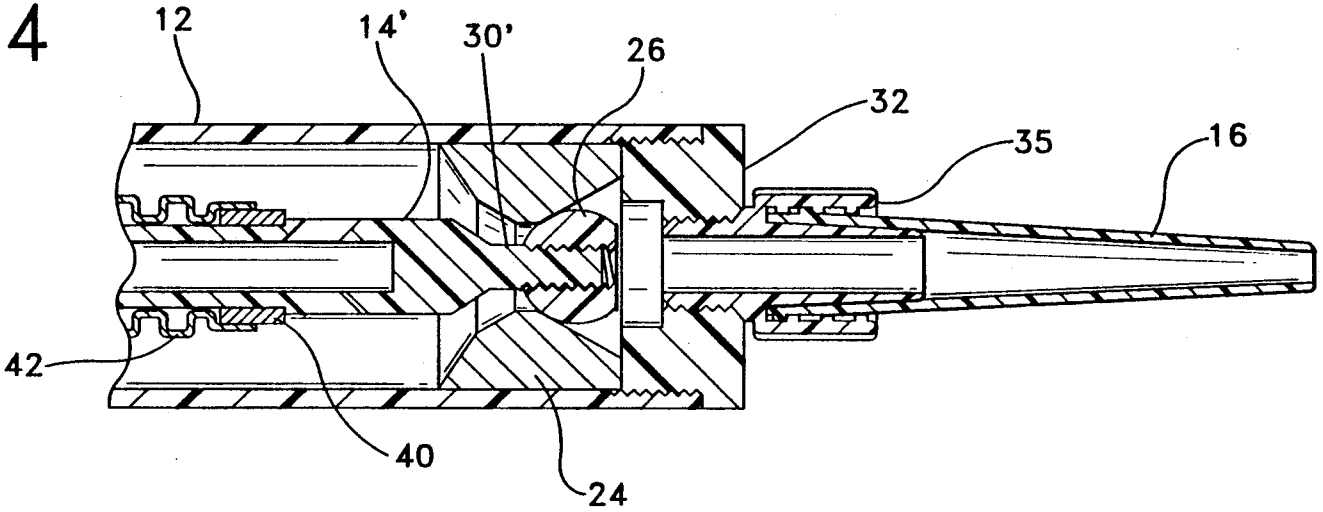
FIG. 4 is an enlarged, sectional view of the discharge end of the apparatus according to an alternative embodiment of the invention.

The use of a valve member 26 as shown in FIGS. 2–4 not only allows fluid to be dispensed in precise quantities when moved away from the valve seat, but also creates a partial vacuum when retracted. This prevents stringing and/or dripping of the fluid as discussed in U.S. Pat. No. 4,930,669. The valve member 26 includes a threaded opening 28 (FIG. 5) aligned with the longitudinal axis of the slide 20. The slide includes a stem 30 having a threaded end 30A (FIG. 5) to which the valve member is secured. The valve member may alternatively be secured to the stem by an adhesive or a snap fitting. The rear end 30B (FIG. 5) of the stem is unthreaded and is positioned within the slide passage 20. The stem may be secured to the slide by an adhesive, or may simply be press fit therein. In an alternative embodiment of the invention as shown in FIG. 4, the stem 30' is formed integrally with the slide 14'.

A first adapter 32 is threadably secured to one end of the housing 12. The adapter adjoins the valve seat 24, and includes a partially threaded, axial passage 34 through which fluid from the valve seat area may exit. The nozzle 16 is secured to a second adapter 35 which has a threaded end extending within the threaded portion of the first adapter. The second adapter includes an axial passage which allows fluid to pass from the passage 34 in the first adapter 32 to the conical passage in the nozzle.

The rear end of the housing 12 includes an end wall 12A and a cylindrical, axial projection 12B through which the slide 14 extends. A cylindrical member 36 is secured to the inner surface of the housing near the rear end. A slide support 38, which is preferably made from a heat-conductive material such as stainless steel, is secured to the cylindrical member 36 and extends along the longitudinal axis of the housing towards the discharge end thereof. The slide 14 is slidably supported by the slide support 38 and the axial projection 12B of the housing.

A heat-conductive ring 40 is fixedly secured to the slide between the slide support 38 and the outlet ports 22. The ring is preferably made from stainless steel or other material which is resistant to corrosive materials. It may be formed as an integral part of the slide if the slide is also made of a heat-conductive material. In either event, it may be considered a part of the slide.

A generally cylindrical bellows seal 42 is secured at one end to an axial-projection 38A extending from the slide support 38 and at its opposite end to the ring 40. While clamping assemblies may be employed to secure the ends of the bellows seal, such assemblies are preferably avoided if a miniaturized assembly is desired. The bellows seal 42 is preferably made from fluorinated ethylene-propylene, which is commonly sold under the trademark TEFLON. In order to secure it to the slide support 38 and ring 40, a thin coating of fluorinated ethylene-propylene may be first applied to the support and ring. The ends of the seal are positioned over these elements, which are then heated from within until the coatings and the ends of the seal are fused. Upon cooling, the bellows seal is thereby secured in a leak-proof manner. If clamps are used, they are preferably made from a material such as tantalum which is highly resistant to corrosion.

A more preferred way of securing the bellows seal to the slide support and ring is through the use of epoxy. The bellows seal is ammonia etched, and the slide support and ring sand blasted prior to the application of the epoxy. A low viscosity, two part epoxy such as MEGABOND 17102 is one epoxy which may be successfully employed. MEGABOND 17102 is a product of Loctite Corporation of Newington, Conn. The product includes an epoxy resin and polymercaptan hardener, and exhibits rapid curing.

Another alternative for securing the bellows seal to the slide support is to manufacture the slide support and bellows seal as an integral assembly. Both elements could be made from TEFLON or other suitable material as a single molded piece.

In operation, fluid is introduced to the reservoir 18 through the passage 20 within the slide 14. Assuming the valve member 26 is not engaging the valve seat 24, the reservoir and nozzle 16 can be filled with fluid. Once this has been accomplished, fluid may be dispensed with high accuracy either by a continuous flow or drop by drop. As a maximum stroke of only about twenty to thirty thousandths of an inch is required to cause the valve member 26 to move sufficiently off the valve seat 24, only a short corrugated section is required between the ends of the bellows seal 42. Maximum flows are typically achieved in the apparatus with a displacement of only about ten thousandths of an inch from the valve seat. Small drops can be generated repeatedly by reciprocation of the slide 14 by the actuator while maintaining high fluid pressure within the reservoir 18. A bellows seal having a three eighths inch bore and a wall thickness between 0.015–0.020 inches has a hoop strength sufficient to withstand about 400 psi. This is more than sufficient for most, if not all applications. Even when the slide is reciprocated repeatedly for drop by drop dispensing of fluid, only minimal turbulence occurs within the reservoir. This prevents the formation of bubbles in the fluid. As the slide reciprocates, fluid is dispensed through the nozzle when the valve member 26 is moved off the valve seat 24, and partially sucked back into the nozzle when the valve member moves towards the valve seat. Unwanted dripping from the nozzle is accordingly prevented. The reservoir stays full as dispensed fluid is replaced by fluid introduced through the slide passage 20.

Figure 6:
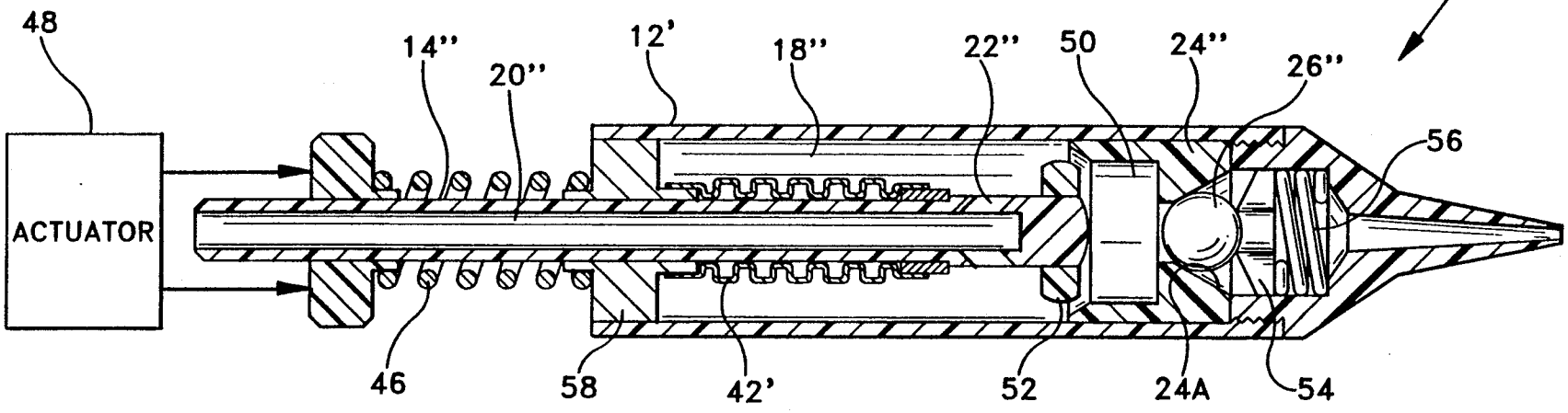
FIG. 6 is a sectional view of an alternative embodiment of the invention which dispenses fluid via positive displacement.
Figure 5:
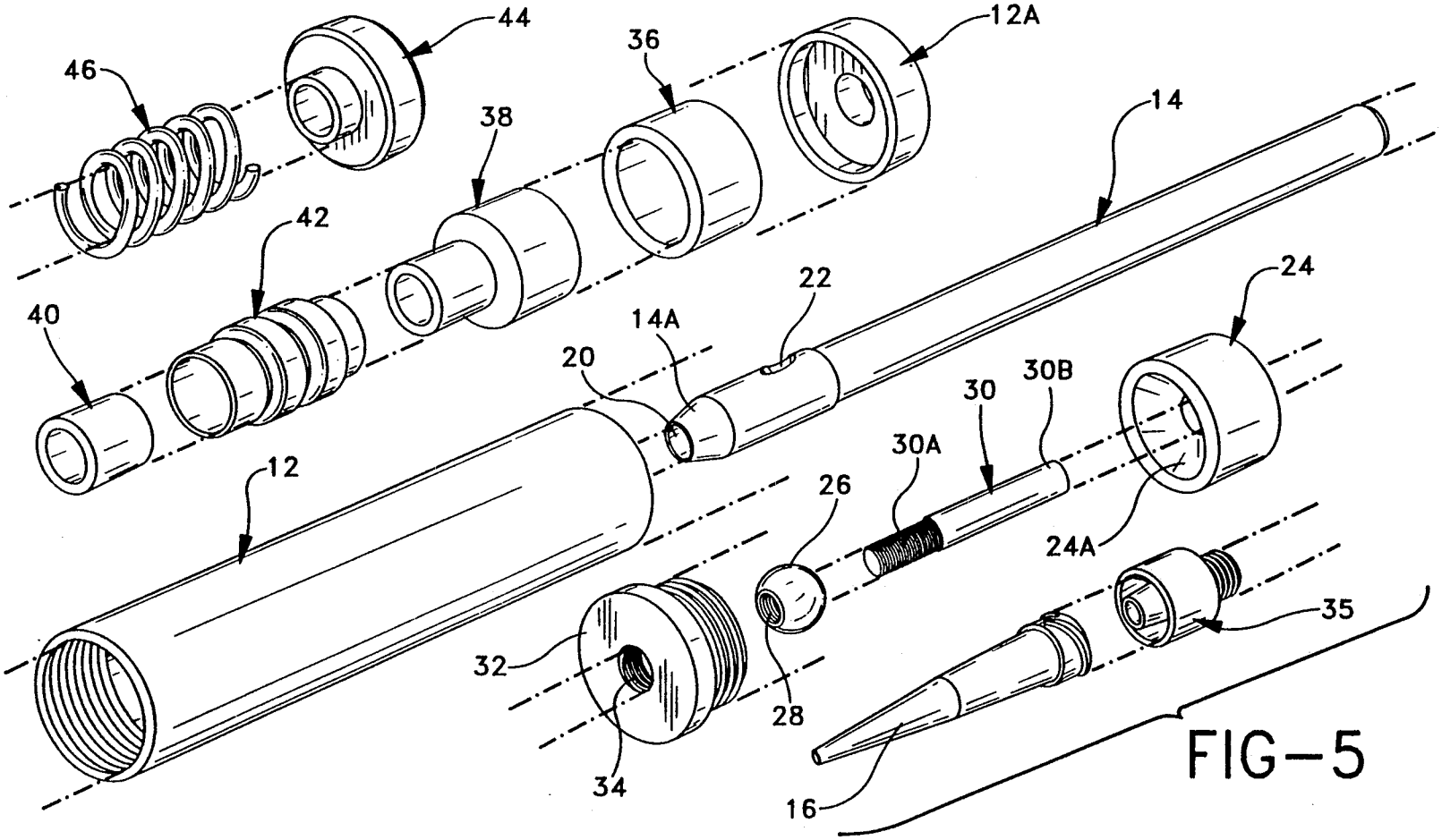
FIG. 5 is an exploded, perspective view of the dispensing apparatus according to the invention.

Referring now to FIG. 6, an alternative embodiment of the invention which operates via positive displacement is shown. The apparatus 10" includes many of the same elements as that shown in FIGS. 1-5, which have been designated by the same numerals as employed therein. The slide 14" includes a passage 20" which allows fluid to enter a reservoir 18" through a pair of radially extending ports 22". A valve seat 24" is provided at the discharge end of the apparatus. Like the valve seat 24 employed in the previously discussed apparatus, it includes a conical surface 25A" capable of making sealing contact with the valve member 26". The valve member is not secured to the slide in this embodiment, and accordingly is only indirectly responsive to movement of the slide. The opposite end of the valve seat, however, defines a cylindrical chamber 50. As shown in FIG. 6, the valve seat 24" may be made from polypropylene, in which case the valve member can be stainless steel. These elements can alternatively be made from other materials as described above. A resilient sealing ring 52 is secured to, or formed integrally with, the front end of the slide 14". The sealing ring is capable of making sealing contact with the walls of the chamber 50.

The valve member 26" is maintained in sealing contact with the conical surface 24A" of the valve seat 24" by a retainer 54. The retainer is urged rearwardly by a coil spring 56.

As the stroke of a positive displacement pump is considerably longer than the stroke of the apparatus discussed previously, the bellows seal 42" must be capable of greater axial expansion than is necessary in this apparatus. As shown in FIG. 6, the seal includes more corrugations to allow the slide 14" to move a distance at least as great as the axial length of the chamber 50. The bellows seal is secured directly to the slide by a metallic ring 40 at one end, the other end thereof being secured to a metallic, heat-conducting support 58 which closes off the rear end of housing 12. Both the ring and support may be made from stainless steel.

In operation, fluid is introduced to the reservoir through the passage 20" and ports 22" within the slide 14". The actuator 48 causes the slide to reciprocate at a selected rate. During the forward stroke, the sealing ring 52 is moved into sealing contact with the walls of the chamber 50. As the slide continues to move forwardly, the sealing ring causes the contents of the chamber to be displaced towards the nozzle 16, thereby causing the valve member to be displaced from the valve seat. A corresponding volume of material is dispensed by the nozzle. The rearward stroke of the slide causes the sealing ring 52 to move outside the chamber 50. The valve member is moved back into sealing engagement with the valve seat at this time by the spring and retainer. As fluid is supplied under pressure through the slide, the reservoir 18 and chamber 50 are refilled prior to the next forward stroke.

Although illustrative embodiments of the present invention have been described herein with reference to accompanying drawings, it is to be understood that the invention is not limited to those precise embodiments, and that various other changes and modifications may be effected therein by one skilled in the art without departing from the scope or spirit of the invention.

What is claimed is:

1. A dispensing apparatus comprising:

a housing defining a reservoir and including a discharge port through which fluid within said reservoir may be dispensed;

an elongate slide positioned within said housing, said slide including a longitudinal passage extending at least partially therethrough and an opening communicating said passage with said reservoir;

a support positioned with said housing, said slide extending through said support;

a longitudinally expandable seal positioned within said reservoir, said seal being secured to said slide and to said support, said slide extending through said seal, said seal being capable of preventing fluid within said reservoir from entering said support;

valve means secured to said housing and responsive to axial movement of said slide for controlling the dispensing of fluid through said discharge port.

2. An apparatus as described in claim 1, wherein said valve means include a valve seat having first and second conical end portions.

3. An apparatus as described in claim 2, wherein said slide includes a conical end surface which is sealingly engageable with said first conical end portion of said valve seat, a valve member secured to said slide, said valve member being sealingly engageable with said second conical end portion of said valve seat.

4. An apparatus as described in claim 1, wherein said valve means include a valve seat defining said discharge port and a valve member responsive to the axial position of said slide and engageable with said valve seat, said opening within said slide being radially oriented with respect to the longitudinal axis of said slide and positioned between an end of said seal and said valve seat.

5. An apparatus as described in claim 4, wherein said opening within said slide is oriented at least partially towards said valve seat.

6. An apparatus as described in claim 1, wherein said seal is a bellows seal having a first end directly secured to said slide without the use of a clamp.

7. An apparatus as described in claim 6, wherein said support slidably supports said slide and includes an axial projection extending into said reservoir, said bellows seal having a second end directly secured to said axial projection without the use of a clamp.

8. An apparatus as described in claim 7 including a heat-conductive ring secured to said slide, said first end of said bellows seal being secured directly to said ring.

9. An apparatus as described in claim 8, wherein said support is made from a heat-conductive material.

10. An apparatus as described in claim 6 wherein said bellows seal is substantially coaxial with said slide.

11. An apparatus as described in claim 10, wherein said opening within said slide is adjacent to said first end of said bellows seal.

12. An apparatus as described in claim 11, wherein said slide includes a plurality of openings communicating said passage with said reservoir, each of said openings extending radially with respect to the longitudinal axis of said slide and generally towards said valve means.

13. An apparatus as described in claim 1 including a sealing ring mounted to said slide, means defining a chamber within said housing in fluid communication with said reservoir, said sealing ring being capable of closing an end of said reservoir upon axial movement of said slide and displacing fluid in said chamber towards said valve means.

14. An apparatus as described in claim 1 including means for reciprocating said slide along its longitudinal axis.

15. A dispensing apparatus comprising:

a housing defining a reservoir therein;

a slide slidably mounted within said housing, said slide including a longitudinal passage extending at least partially therethrough and a radially extending opening communicating said passage with said reservoir;

a support positioned within said housing, said slide extending through said support and into said reservoir;

a bellows seal connected between said support and said slide, said slide extending through said bellows seal, and valve means responsive to said slide for controlling the flow of fluid from said reservoir.

16. An apparatus as described in claim 15, wherein said bellows seal is directly secured to said slide and said support without the use of clamps.

17. An apparatus as described in claim 15, wherein said valve means include a valve seat having first and second conical end portions, one of said end portions adjoining said reservoir.

18. An apparatus as described in claim 17, wherein said end portion adjoining said reservoir includes a pair of adjoining, frustoconical surfaces.

19. An apparatus as described in claim 15, wherein said radially extending opening extends towards said valve means.

20. An apparatus as described in claim 15, wherein said housing is substantially cylindrical, said valve means is positioned near one end of said housing, said slide includes a closed end adjacent to said valve means, said radially extending opening being positioned between said bellows seal and said closed end of said slide.

* * * * *